US007775382B2

(12) United States Patent
Wüster

(10) Patent No.: US 7,775,382 B2
(45) Date of Patent: Aug. 17, 2010

(54) UMBRELLA-LIKE LAUNDRY DRYER WITH ACTUATING DEVICE

(76) Inventor: Heinrich Wüster, Unterm Hohen Rain 16, Imst/Tirol (AT) A-6460

( * ) Notice: Subject to any disclaimer, the term of this patent is extended or adjusted under 35 U.S.C. 154(b) by 668 days.

(21) Appl. No.: 11/487,125

(22) Filed: Jul. 14, 2006

(65) Prior Publication Data

US 2007/0034586 A1 Feb. 15, 2007

(30) Foreign Application Priority Data

Jul. 14, 2005 (AT) ..... 1193/2005

(51) Int. Cl.
*A47B 43/00* (2006.01)
*A47F 5/04* (2006.01)

(52) U.S. Cl. ..... 211/197; 211/171

(58) Field of Classification Search ..... 211/197, 211/85.24, 193, 195, 196, 119.01, 205, 107, 211/99, 100, 1.3, 96, 168, 171; 135/98, 20.3, 135/27, 29, 31, 15.1, 16; 254/4 R, 8 R, 243, 254/390, 391, 392; 34/239
See application file for complete search history.

(56) References Cited

U.S. PATENT DOCUMENTS

| | | | | | |
|---|---|---|---|---|---|
| 25,868 | A | * | 10/1859 | Palmer | 211/197 |
| 204,179 | A | * | 5/1878 | Wilson | 211/197 |
| 207,586 | A | * | 9/1878 | Benstine et al. | 211/163 |
| 458,418 | A | * | 8/1891 | Everett | 211/165 |
| 459,644 | A | * | 9/1891 | McCandless | 211/167 |
| 461,964 | A | * | 10/1891 | Sobolewski | 211/165 |
| 463,540 | A | * | 11/1891 | McKinnon | 211/165 |
| 882,960 | A | * | 3/1908 | Peterson | 211/197 |
| 999,189 | A | * | 7/1911 | Altavater | 211/47 |
| 1,475,369 | A | * | 11/1923 | Coulter | 211/166 |
| 1,801,913 | A | * | 4/1931 | Frederick | 135/98 |

(Continued)

FOREIGN PATENT DOCUMENTS

AT 312548 B 1/1974

(Continued)

OTHER PUBLICATIONS

Austrian Search Report dated Jun. 20, 2006.

(Continued)

*Primary Examiner*—Michael Safavi
(74) *Attorney, Agent, or Firm*—Laurence A. Greenberg; Werner H. Stemer; Ralph E. Locher

(57) ABSTRACT

An umbrella-like laundry dryer includes a central upright tube and a clothes-line-carrying framework, which can be unfolded by an actuating device and has supporting arms connected movably to an upper end section of the upright tube and clothes-line carrying arms connected for articulation to lower ends of the supporting arms and linked to a lower sleeve to be displaced along the upright tube. The actuating device has a hoisting line anchored to the upper end section of the upright tube, running downward parallel to the upright tube and deflected away at the lower sleeve from the upright tube. The hoisting line is coupled to an opening lever linked to a clothes-line carrying arm above the lower sleeve for pivoting from a downwardly pointing, lower position into an upwardly pointing, upper position, to unfold the carrying framework.

25 Claims, 5 Drawing Sheets

U.S. PATENT DOCUMENTS

| | | | | | |
|---|---|---|---|---|---|
| 2,474,922 | A | * | 7/1949 | Unwin | 211/167 |
| 2,620,210 | A | * | 12/1952 | Wuster | 403/327 |
| 2,621,670 | A | * | 12/1952 | Wuster | 135/22 |
| 2,816,560 | A | * | 12/1957 | Wuster | 135/23 |
| 3,160,166 | A | * | 12/1964 | Wuster | 135/26 |
| 3,850,186 | A | * | 11/1974 | Weber et al. | 135/20.3 |
| 4,206,847 | A | * | 6/1980 | Brink | 211/1.3 |
| 4,512,554 | A | * | 4/1985 | Racine | 254/131 |
| 4,586,525 | A | * | 5/1986 | Glatz et al. | 135/20.1 |
| 4,606,366 | A | * | 8/1986 | Collet | 135/20.1 |
| 4,676,381 | A | * | 6/1987 | Wuster | 211/119.01 |
| 4,732,285 | A | * | 3/1988 | Wuster | 211/197 |
| 4,735,322 | A | * | 4/1988 | Steiner | 211/119.01 |
| 4,735,326 | A | * | 4/1988 | Steiner | 211/197 |
| 4,813,442 | A | * | 3/1989 | Haines | 135/98 |
| 5,280,841 | A | * | 1/1994 | Van Deursen | 211/197 |
| 5,492,232 | A | | 2/1996 | Ohm | |
| 5,564,453 | A | * | 10/1996 | Steiner | 135/98 |
| 5,797,504 | A | * | 8/1998 | Mangum | 212/303 |
| 5,871,024 | A | * | 2/1999 | Vanderminden, Sr. | 135/20.1 |
| 6,202,660 | B1 | * | 3/2001 | Steiner | 135/22 |
| 6,386,214 | B1 | * | 5/2002 | Clarke | 135/20.3 |
| 7,000,788 | B2 | * | 2/2006 | Wuster | 211/197 |
| 7,127,829 | B2 | * | 10/2006 | Wuster | 34/239 |
| 7,175,035 | B2 | * | 2/2007 | Wuster | 211/197 |
| 7,188,854 | B1 | * | 3/2007 | Pickens | 280/293 |
| 2004/0134870 | A1 | * | 7/2004 | Daubach et al. | 211/196 |
| 2005/0040125 | A1 | * | 2/2005 | Wuster | 211/197 |
| 2005/0145590 | A1 | * | 7/2005 | Wuster | 211/197 |
| 2005/0150128 | A1 | * | 7/2005 | Wuster | 34/239 |
| 2006/0180687 | A1 | * | 8/2006 | Wuster | 241/214 |
| 2007/0034586 | A1 | | 2/2007 | Wuster | |

FOREIGN PATENT DOCUMENTS

| | | | |
|---|---|---|---|
| AT | 502115 | A1 | 1/2007 |
| AT | 502115 | B1 | 6/2007 |
| CH | 388894 | A | 3/1965 |
| DE | 1950218 | U | 11/1966 |
| EP | 1743972 | A1 | 1/2007 |
| FR | 2444744 | A1 | 7/1980 |
| GB | 209398 | A | 10/1924 |
| GB | 869340 | A | 5/1961 |
| GB | 1433625 | A | 4/1976 |

OTHER PUBLICATIONS

European Search Report dated Oct. 4, 2006.

* cited by examiner

UMBRELLA-LIKE LAUNDRY DRYER WITH ACTUATING DEVICE

BACKGROUND OF THE INVENTION

Field of the Invention

The invention relates to an umbrella-like laundry dryer, in which a central upright tube carries a multi-armed carrying framework for a clothes line. The carrying framework can be unfolded by an actuating device, can be fixed in an unfolded state, has supporting arms which are disposed in a star-shaped manner and are connected movably to an upper end section of the upright tube and has carrying arms for the clothes line. The carrying arms are disposed in a star-shaped manner, are connected in an articulated manner to lower ends of the supporting arms, are linked to a lower sleeve which can be displaced along the upright tube and can be spread out from the upright tube. The actuating device has a hoisting line which is anchored at its upper end to the upper end section of the upright tube, runs downward parallel to the upright tube and is deflected away from the upright tube at the lower sleeve of the carrying framework.

Umbrella-like laundry dryers, which are referred to as spoked laundry dryers, are generally set up outside in practice. They often remain in a collapsed state for a long period of time and are only unfolded directly before use. The upright tube is anchored in the ground in a vertical position in a ground sleeve. When the carrying framework is collapsed, the supporting arms hang downward along the upright tube and the carrying arms for the clothes line are each pivoted upward toward the upright tube. In the collapsed carrying framework, the hoisting line of the actuating device runs downward parallel to the upright tube as far as the lower sleeve of the carrying framework that is disposed just above the ground. The hoisting line is deflected there away from the upright tube and protrudes out of the carrying framework by a short distance.

In order to make the laundry dryer ready for use, the hoisting line is pulled away laterally from the upright tube. As a result, the lower sleeve is pulled upward on the upright tube, the carrying arms linked thereto are pivoted away from the upright tube, the carrying framework is unfolded and, in the last part of that movement, the clothes line is tightened or tensioned. The carrying arms, which are disposed in a star-shaped manner, are pivoted away from the upright tube in the radial direction and also move horizontally apart, so that the lateral distance between them becomes ever greater. That enlargement of the distance between them causes the clothes line disposed between the carrying arms to be pulled out and tensioned horizontally. The fixing of the unfolded carrying framework generally takes place through the lower sleeve of the carrying framework that carries a fixing device which interacts with a vertical perforated rail fitted on the upright tube.

When the carrying framework is unfolded, its vertical longitudinal extent is shortened to less than a third and a hoisting-line length corresponding to that shortening is pulled laterally out of the carrying framework. The pulled-out hoisting line has to be supplied when the carrying framework is unfolded and, before the carrying framework is collapsed, has to be freed from knots and/or accumulation of dirt which have occurred in the meantime, so that the collapsing of the carrying framework is not obstructed or prematurely ended by the hoisting line which is to be retracted into the carrying framework.

During the unfolding of the carrying framework, a great amount of force is required just in the last section of the unfolding movement if the sections of clothes line disposed between the carrying arms are to be tightened and subsequently tensioned by the enlargement of the lateral distances between the carrying arms.

Umbrella-like laundry dryers are known, in which the carrying framework is supported by the supporting arms on an upper sleeve anchored to the upper end section of the upright tube, and in which the actuating device provided for the unfolding of the carrying framework is provided with a force multiplication, similar to a block-and-tackle, for the hoisting line. The force multiplication is produced by the hoisting line, which is guided back and forth a number of times between upper and lower sleeves in the carrying framework, for which, in comparison to an actuating device without a block-and-tackle, three times the length of the hoisting line is required for a doubling of the force and five times the length of the hoisting line is required for a quadrupling of the force. A disadvantage thereof is that virtually the entire three times or five times the length of the hoisting line has to be pulled out of the collapsed carrying framework before the respective force multiplication can be used in the last section of the unfolding movement of the carrying framework. The use of a hoisting-line block-and-tackle leads to a significant slowing of the unfolding movement of the carrying framework and involves a hoisting line which is three times or five times as long. Of the latter, virtually the entire length has to be pulled through the block-and-tackle in order to unfold the carrying framework and has to be pulled out of the carrying framework on the lower sleeve. When the carrying framework is unfolded, the majority of the hoisting line which is three times or five times the length has to be supplied and, before the carrying framework is collapsed, has to be freed from any possible knots and dirt, so that the length of hoisting line can be retracted again without obstruction through the block-and-tackle into the carrying framework.

SUMMARY OF THE INVENTION

It is accordingly an object of the invention to provide an umbrella-like laundry dryer with an improved actuating device, which overcomes the hereinafore-mentioned disadvantages of the heretofore-known devices of this general type.

With the foregoing and other objects in view there is provided, in accordance with the invention, an umbrella-like laundry dryer, comprising a central upright tube having an upper end section. A multi-armed, clothes-line-carrying framework can be unfolded and fixed in an unfolded state. The carrying framework is carried by the upright tube. The carrying framework has supporting arms disposed substantially in a star-shape and movably connected to the upper end section of the upright tube. The supporting arms have lower ends. The carrying framework has clothes-line carrying arms to be spread out from the upright tube. The carrying arms are disposed substantially in a star-shape and connected for articulation to the lower ends of the supporting arms. The carrying framework has a lower sleeve to be displaced along the upright tube. The lower sleeve is linked to the carrying arms. An actuating device for unfolding the carrying framework has a hoisting line with an upper end anchored to the upper end section of the upright tube. The hoisting line runs downward substantially parallel to the upright tube and is deflected away from the upright tube at or near the lower sleeve of the carrying framework. The actuating device has an opening lever with a free actuating end and a line engagement element disposed adjacent the actuating end and coupled to the hoisting line. The opening lever is linked to one of the clothes-line carrying arms above the lower sleeve. The opening lever can be pivoted from a downwardly pointing, lower position into an upwardly pointing, upper position for unfolding the carrying framework.

This construction simplifies the unfolding of the clothes-line carrying framework when opening the laundry dryer. In the collapsed state of the carrying framework, the supporting arms hang downward along the upright tube, and the carrying arms carried by the supporting arms are pivoted upward at their outer ends to the upper end section of the upright tube. The actuating device opening lever, which is linked to a clothes-line carrying arm, is pivoted into its lower position in which its actuating end is disposed next to the lower sleeve of the carrying framework. In order to open the laundry dryer, the opening lever is pulled away laterally at its actuating end from the upright tube and is pivoted on the clothes-line carrying arm into its upper position. During this pivoting movement of the opening lever, the lower sleeve of the carrying framework is pulled upward on the upright tube by the hoisting line, the clothes-line carrying arms, which are linked to the lower sleeve, are pivoted away from the upright tube, the clothes-line sections disposed between the clothes-line carrying arms are spread out horizontally and the carrying framework is unfolded. In the opening lever, the line engagement element, which is coupled to the hoisting line, is moved away in an arc from the lower end of the clothes-line carrying arm beyond the pivot axis of the opening lever to the upper half of the clothes-line carrying arm. That section of the opening lever which is situated between the pivot axis and the line engagement element serves as a force multiplication for the hoisting line coupled to the line engagement element. When the opening lever is pivoted upward, a hoisting-line length corresponding approximately to twice the length of this lever section is pulled out of the carrying framework and the lower sleeve thereof is raised by an equivalent distance along the upright tube. The opening lever, together with the clothes-line carrying arm carrying it, forms a toggle lever which is stretched or elongated when the opening lever is pivoted upward and, in the last section of the pivoting movement of the opening lever, deploys its greatest force-multiplication effect.

In accordance with another feature of the invention, at least two line engagement elements are provided for the hoisting line. The line engagement elements are disposed at different distances from the pivot axis of the opening lever coupled to the hoisting line.

This construction permits the hoisting-line length which is effective during the pivoting of the opening lever to be adjusted on the opening lever itself in order to match the unfolded carrying framework to a clothes line which has become longer. The length of the hoisting line which is pulled out of the carrying framework when the opening lever is pivoted, can be enlarged by transferring the lower end of the hoisting line from the line engagement element situated closer to the lever pivot axis to the line engagement element situated further away from the lever pivot axis. As a result, during the pivoting of the opening lever, the lower sleeve of the carrying framework is raised further on the upright tube and the carrying framework is unfolded further. In the process, the clothes-line carrying arms are spread apart further laterally and a clothes line which has become longer is also tensioned in the horizontal direction.

In accordance with a further feature of the invention, the carrying framework has an upper sleeve which is anchored to the upper end section of the upright tube and to which the supporting arms are linked at their upper ends, and the hoisting line, which is coupled to the opening lever of the actuating device, is anchored at its upper end to the upper sleeve of the carrying framework.

In accordance with an added feature of the invention, the carrying framework has an upper sleeve, which is provided with a fixing device fixable to the upright tube, which can be anchored at different height positions in the upper part of the upright tube and to which the supporting arms are linked at their upper ends. The hoisting line, which is coupled to the opening lever of the actuating device, is anchored at its upper end to the upper sleeve of the carrying framework.

In accordance with an additional feature of the invention, the opening lever can be coupled to a hoisting line having an upper end which can be anchored at different height positions in an anchoring device disposed in the region of the upper end section of the upright tube.

This construction permits the hoisting-line length which is effective during the pivoting of the opening lever to be adjusted at the upper end of the hoisting line in order to match the unfolded carrying framework to a clothes line which has become longer. By setting the upper end of the hoisting line higher, the lower sleeve of the carrying framework is raised further on the upright tube during the pivoting of the opening lever and the carrying framework is unfolded further. In the process, the clothes-line carrying arms are spread apart further laterally and a clothes line which has become longer is also tensioned in the horizontal direction.

In accordance with yet another feature of the invention, the anchoring device associated with the upper end of the hoisting line can have at least two anchoring positions, which are disposed vertically one above the other, for the upper end of the hoisting line.

If the laundry dryer has a carrying framework in which the supporting arms are linked at their upper ends to an upper sleeve, then the anchoring device associated with the upper end of the hoisting line can be fitted to the upper sleeve of the carrying framework.

In accordance with yet a further feature of the invention, the opening lever, which is coupled to the hoisting line, is coupled to a gas-filled compression spring which assists the unfolding of the carrying framework and is linked to the opening lever itself and to the clothes-line carrying arm carrying the opening lever. The gas-filled compression spring is activatable by pivoting the opening lever upward, and the carrying framework is unfoldable by the gas-filled compression spring, which automatically pivots the opening lever upward, until it reaches that position of the clothes-line carrying arms which corresponds to the tensioned clothes line.

This construction simplifies the unfolding of the carrying framework. The opening lever only has to be pivoted by hand from its lower position away from the upright tube and upward until the gas-filled compression spring is activated and the latter takes over the further unfolding of the carrying framework. Depending on the extended length of the gas-filled compression spring, the carrying framework can be unfolded by pivoting the opening lever upward in each case until it reaches a predetermined end position or in each case until the clothes line is tensioned in the horizontal direction.

In accordance with yet an added feature of the invention, a gas-filled compression spring is linked to the clothes-line carrying arm in the vicinity of the lower end thereof and to the opening lever in a third of the length thereof adjoining its pivot axis.

In accordance with yet an additional feature of the invention, the carrying framework, which is unfolded by pivoting the opening lever, can be fixed on the upright tube. For this purpose, the carrying framework lower sleeve, which is connected movably to the lower ends of the carrying arms, can carry a fixing device which can be fixed on the upright tube.

In accordance with again another feature of the invention, the clothes-line carrying framework, which is unfolded by pivoting the opening lever, can be fixed on the clothes-line carrying arm carrying the opening lever. A locking device for the opening lever when it is pivoted into its upper position is provided on the clothes-line carrying arm for this purpose.

In accordance with again a further feature of the invention, the locking device is constructed as a shear bolt which, when the opening lever is pivoted upward, can be inserted into a hole in the opening lever. That hole is brought to overlap with a hole in the clothes-line carrying arm.

In accordance with again an added feature of the invention, the locking device has ball-type catches which are fitted laterally to the clothes-line carrying arm and, when the opening lever is pivoted upward, can be brought into engagement with recesses in the opening lever.

In accordance with again an additional feature of the invention, the opening lever of the actuating device is linked to a clothes-line carrying arm which, in its upper half, carries a locking device for the opening lever when it is pivoted into its upper position.

The locking device can have an angle lever which is mounted pivotably on the clothes-line carrying arm and can be brought into engagement with the actuating end of the opening lever.

The locking device can have a cable loop which is coupled to the clothes-line carrying arm, can be brought into engagement with the actuating end of the opening lever and can be adjusted if appropriate.

The locking device can have a sleeve which can be displaced along the clothes-line carrying arm and can be brought into engagement with the actuating end of the opening lever.

The locking device can have a toggle which protrudes from the lower side of the clothes-line carrying arm, passes, when the opening lever is pivoted upward, through a passage opening adjacent its actuating end, and can be transferred from a straight position into a bent position blocking the opening lever.

The locking device can have a rotatable clamp which is fitted to the lower side of the clothes-line carrying arm and can be rotated from a rest position into a blocking position engaging over the opening lever when it has been pivoted upward.

In accordance with still another feature of the invention, the opening lever has a handle which, in its downwardly pointing, lower position, protrudes over the carrying framework when the carrying framework is collapsed.

In accordance with still a further feature of the invention, the hoisting line, which is coupled to the opening lever, can be constructed as a cable loop engaging on a line engagement element of the opening lever.

In accordance with still an added feature of the invention, the cable loop has two cable sections which run parallel to each other, run downward parallel to the upright tube and, on the lower sleeve of the carrying framework, are deflected away from the upright tube through rotatable pulleys.

In accordance with a concomitant feature of the invention, there is provided a tubular protective sheath which is accommodated in the upright tube, is pulled out of the upright tube over the collapsed carrying framework together with the clothes line and the opening lever in order to protect the clothes line and is anchored to the upright tube at the lower end of the carrying framework or below the latter.

Other features which are considered as characteristic for the invention are set forth in the appended claims.

Although the invention is illustrated and described herein as embodied in an umbrella-like laundry dryer with an actuating device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
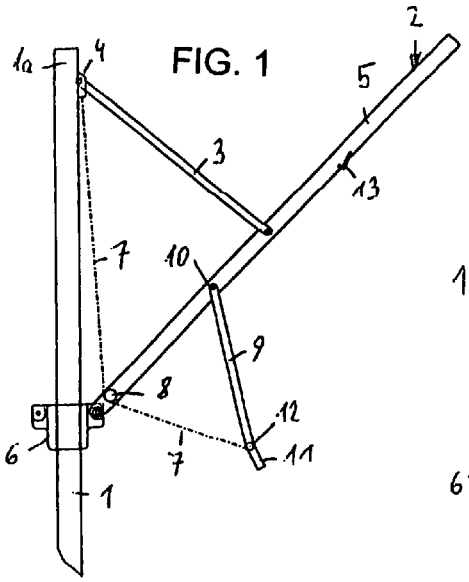
FIG. 1 is a fragmentary, diagrammatic, side-elevational view of a laundry dryer with a carrying framework partially unfolded.

Referring now to the figures of the drawings in detail and first, particularly, to FIG. 1 thereof, there is seen an umbrella-like laundry dryer with a central upright tube 1 which carries a multi-armed carrying framework 2 for a clothes line or washing line. The clothes line has been omitted for the sake of better clarity. The carrying framework 2 has four supporting arms 3 which are disposed in a star-shaped manner around the upright tube 1 and are linked directly at their upper ends to an upper end section 1*a* of the upright tube 1. Vertical ribs 4 to which the supporting arms 3 are linked at their upper ends protrude radially from the upper end section 1*a* of the upright tube 1. The carrying framework 2 furthermore has four clothes-line carrying arms 5 which are disposed in a star-shaped manner around the upright tube 1, are connected in an articulated manner in their central sections to lower ends of the supporting arms 3 and are linked at their lower ends to a lower sleeve 6 which engages around the upright tube 1 and can be displaced vertically along the upright tube 1. In order to unfold the carrying framework 2, the lower sleeve 6 is moved upward along the upright tube 1 through an actuating device. In the process, the clothes-line carrying arms 5 are spread out radially from the upright tube 1 from a substantially vertical position and are pivoted into a position slightly inclined with respect to the horizontal.

FIG. 1 shows the two arms 3, 5 of the carrying framework 2 which are associated with the actuating device, when the carrying framework 2 is partially unfolded. The supporting arm 3 is linked at its upper end to the upper end section 1*a* of the upright tube 1 by a radially protruding, vertically running rib 4. An upper end of a hoisting line 7 of the actuating device is fastened to a lower end of this rib 4. The hoisting line 7 runs from the rib 4 downward in the vicinity of the upright tube 1 to a lower end section of the clothes-line carrying arm 5. The hoisting line 7 is deflected away there from the upright tube 1 at a roller 8 mounted rotatably on the clothes-line carrying arm 5. The hoisting line 7 is coupled at its lower end to an opening lever 9 which is linked above the lower sleeve 6 to the clothes-line carrying arm 5. A pivot shaft or axis 10 of the opening lever 9 is disposed at an upper end of a lower third of the clothes-line carrying arm 5.

The opening lever 9 is constructed as a single-armed lever. It has a free actuating end which is provided with a handle 11. In the vicinity of its actuating end, the opening lever 9 carries a line engagement element 12 at which the opening lever 9 is coupled to the lower end of the hoisting line 7. The opening lever 9 can be pivoted about its pivot shaft 10 from a lower position, in which it bears, with its actuating end pointing downward, against the lower half of the clothes-line carrying arm 5, into an upper position, in which it bears, with its actuating end pointing upward, against an upper half of the clothes-line carrying arm 5.

An angle lever 13 is mounted pivotably at a lower end of an upper third of the clothes-line carrying arm 5. The angle lever 13 is angled at its lower end and the opening lever 9, when it is pivoted into its upper position, can be fixed to the clothes-line carrying arm 5 with the aid of the angled lower end.

When the carrying framework 2 is collapsed, its lower sleeve 6 is in its lowermost position. The clothes-line carrying arms 5 are pivoted by their outer ends upward toward the upright tube 1 and extend upward from the lower sleeve 6 along the upright tube 1. The supporting arms 3, which are linked directly to the upper end section 1*a* of the upright tube 1, extend downward along the upright tube 1 from the ribs 4. In the actuating device, the hoisting line 7 extends downward from the upper end section 1*a* of the upright tube 1 along the upright tube 1 to the respective line engagement element 12 of the opening lever 9 which is coupled to it and, when the carrying framework 2 is collapsed, is disposed next to the lower sleeve 6 of the carrying framework 2. The opening lever 9 is pivoted into its lower position and its handle 11 protrudes over the carrying framework 2 at the lower sleeve 6 of the carrying framework 2.

In order to unfold the carrying framework 2, the opening lever 9 is grasped at the handle 11, is pivoted away from the upright tube 1, is pivoted into its upper position and is then fixed with the aid of the angle lever 13 to the upper half of the clothes-line carrying arm 5. In the process, the hoisting line 7 is pulled by up to approximately two thirds out of the carrying framework 2 and the lower sleeve 6 thereof is raised by the same length. At the same time, the clothes-line sections which are disposed between the clothes-line carrying arms 5 that are moving laterally apart are spread out in the horizontal direction and, toward the end of the pivoting movement of the opening lever 9, are tensioned in the horizontal direction. The opening lever 9, which is fixed to the upper half of the clothes-line carrying arm 5 by the angle lever 13, secures the carrying framework 2 in its unfolded position and fixes the clothes-line sections in their horizontally spread-out position.

The opening lever 9 of the actuating device, together with the clothes-line carrying arm 5 carrying it, forms a toggle lever. When the carrying framework 2 is collapsed, this toggle lever is completely collapsed. When the opening lever 9 is pivoted out of its lower position into its upper position, this toggle lever is first of all unfolded and, toward the end of the pivoting movement, is elongated or stretched. As a result, the maximum force multiplication of the toggle lever, which is associated with the elongation or stretching of a toggle lever, becomes effective at the end of the pivoting movement of the opening lever 9 if a very large force multiplication is required for the tensioning of the clothes line.

Figure 2:
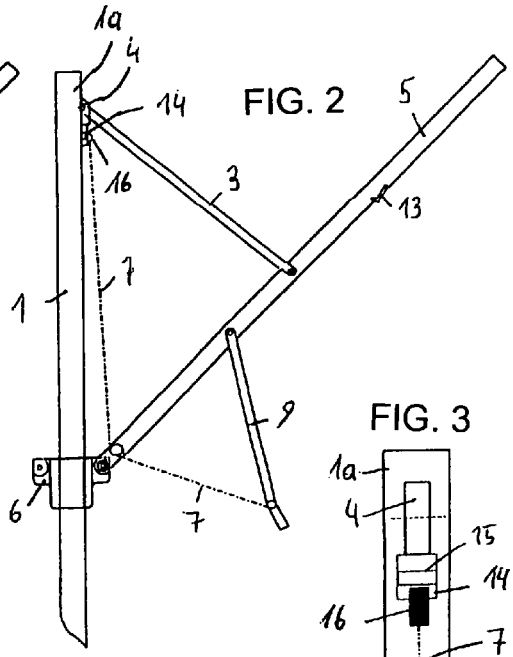
FIG. 2 is a fragmentary, side-elevational view of another laundry dryer with the carrying framework partially unfolded.
Figure 3:
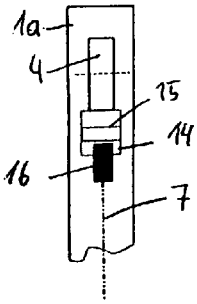
FIG. 3 is an enlarged, fragmentary, front-elevational view of an upper end section of an upright tube of the laundry dryer of FIG. 2 with an anchoring device for an upper end of a hoisting line.

FIG. 2 shows a laundry dryer corresponding to FIG. 1, in which the inclination of the clothes-line carrying arms 5 that can be obtained during the unfolding of the carrying framework 2 can be varied by adjustment of the anchoring point of the upper end of the hoisting line 7.

FIG. 2 shows the actuating device of this laundry dryer with the supporting arm 3, which is linked to the upper end section 1*a* of the upright tube 1 at a vertical rib 4, and the clothes-line carrying arm 5, which is connected in an articulated manner to the lower end of this supporting arm 3, is linked at its lower end to the lower sleeve 6 of the carrying framework 2 and carries the opening lever 9, which is coupled to the hoisting line 7, of the actuating device. An anchoring device 14 is connected to the upper end section 1*a* of the upright tube 1. The anchoring device 14 has a ladder with rungs 15 which are disposed vertically one above the other and into which a hook 16 which is connected to the upper end of the hoisting line 7 is fitted. The anchoring device 14 is attached to the lower end of the vertical rib 4 to which the upper end of the supporting arm 3 is linked. In this anchoring device 14, the height position of the upper end of the hoisting line 7 can be changed by re-fitting the hook 16. When the height position of the hook 16 is changed, the uppermost position, up to which the lower sleeve 6 of the carrying framework 2 can be pulled upward through the hoisting line 7 by the opening lever 9 being pivoted on the upright tube 1, also changes. The uppermost position of the lower sleeve 6 of the carrying framework 2 defines the inclination of the clothes-line carrying arms 5 when the carrying framework 2 is unfolded. If the carrying framework 2 is to be unfolded further, in order to tension a clothes line which has become longer, then the hook 16 is fitted on a higher rung 15 of the anchoring device 14. As a result, during the next pivoting of the opening lever 9, the lower sleeve 6 of the carrying framework 2 is raised somewhat further on the upright tube 1, the clothes-line carrying arms 5 are spread apart somewhat further laterally and the longer clothes line is tensioned in the horizontal direction.

Figure 4:
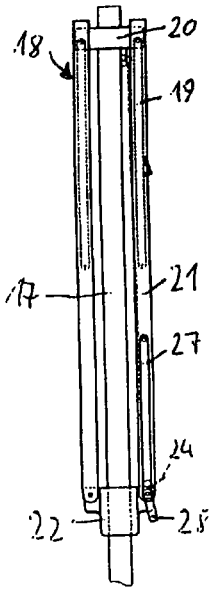
FIG. 4 is a fragmentary, side-elevational view of a further laundry dryer in a collapsed state.
Figure 5:
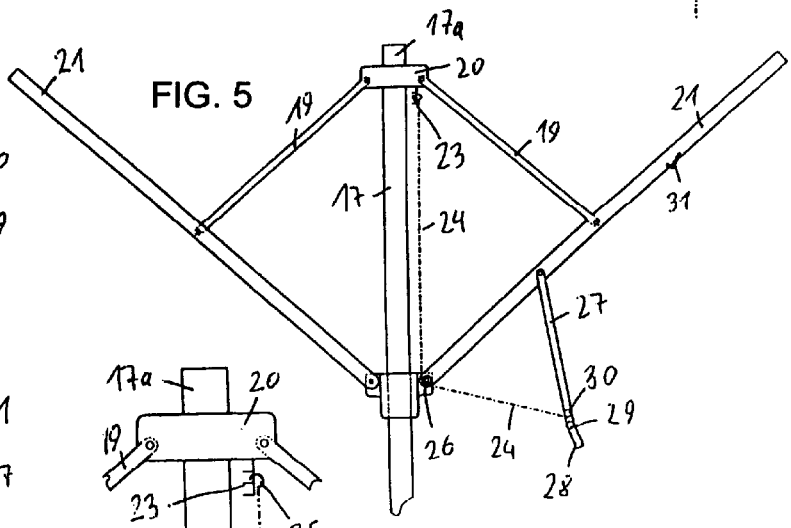
FIG. 5 is a fragmentary, side-elevational view of the laundry dryer of FIG. 4 in the partially unfolded state.
Figure 6:
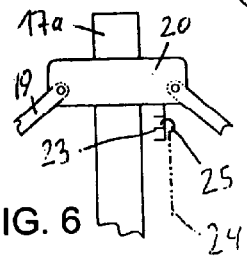
FIG. 6 is an enlarged, fragmentary, side-elevational view showing the upper end section of the upright tube of the laundry dryer of FIGS. 4 and 5 with an anchoring device for the upper end of the hoisting line.

FIGS. 4-6 show a further embodiment of an umbrella-like laundry dryer. In the case of this embodiment, a central upright tube 17 carries a multi-armed clothes-line carrying framework 18, in which supporting arms 19, which are disposed in a star-shaped manner around the upright tube 17, are linked at their upper ends to an upper sleeve 20 which is anchored to an upper end section 17*a* of the upright tube 17. Carrying arms 21, which are linked to lower ends of the supporting arms 19, are linked at their lower ends to a lower sleeve 22 which can be displaced along the upright tube 17. The carrying framework 18 is unfolded with the aid of an actuating device illustrated in the right-hand half of FIGS. 4-6.

The actuating device has an anchoring device 23, which is fitted to the upper sleeve 20, for receiving a hook 25 connected to the upper end of a hoisting line 24. The anchoring device 23 includes a ladder which is formed from wire, hangs down from the upper sleeve 20 and has rungs which are disposed vertically one above the other and at which the hook 25 is fitted in the anchoring device 23. The hoisting line 24, which is constructed as a cable loop, as shown in F*igs*. 19 and 20, extends downward from the hook 25 along the upright tube 17 to the lower sleeve 22. At the lower sleeve 22, two mutually parallel cable sections of the hoisting line 24 are deflected away from the upright tube 17 through two rotatable pulleys 26 which are disposed on both sides of the clothes-line carrying arm 5 and are coaxial with the pivot axis thereof. The hoisting line 24 extends away from the two pulleys 26 as far as an opening lever 27 which is coupled to it and is linked to the clothes-line carrying arm 21 at an upper end of a lower third thereof. The opening lever 27 carries two line engagement elements 29, 30 which are disposed next to each other in the vicinity of a free actuating end 28 of the opening lever 27 and at which it can be coupled in each case to the lower end of the hoisting line 24.

In the case of this actuating device, the uppermost position of the lower sleeve 22, with which the inclination of the clothes-line carrying arms 21 is fixed when the carrying framework 18 is unfolded, can be changed by moving the hoisting line 24. This can take place at the upper end of the hoisting line 24 in which the hook 25 in the anchoring device 23 is fitted into another rung of the ladder and thus the height position of the upper hoisting-line end is changed. This can also take place at the lower end of the hoisting line 24 by moving the lower end of the hoisting line 24, which end is constructed as a loop, from one line engagement element 30 to the other line engagement element 29.

The upper half of the clothes-line carrying arm 21 carries a pivotable hook 31 with which the opening lever 27, which is pivoted upward toward the upper half of the carrying arm 21, can be fixed on the clothes-line carrying arm 21 when the carrying framework 18 is completely unfolded.

Figure 7:
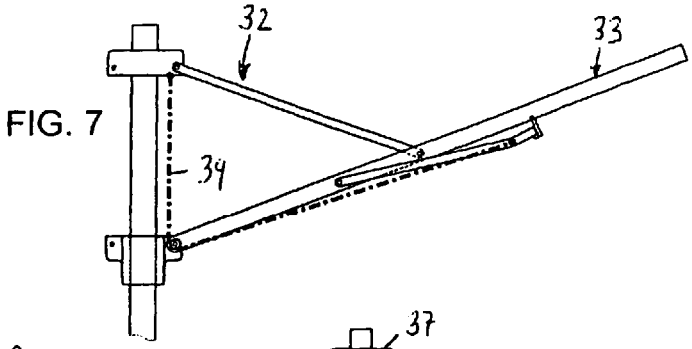
FIG. 7 is a fragmentary, side-elevational view of a further laundry dryer with the carrying framework completely unfolded.

FIG. 7 shows a laundry dryer 32 corresponding to FIGS. 4-6, with a carrying framework 33 completely unfolded. In the case of the actuating device of this laundry dryer 32, no possibility of adjusting the upper or lower end of the hoisting line 34 is provided.

Figure 8:
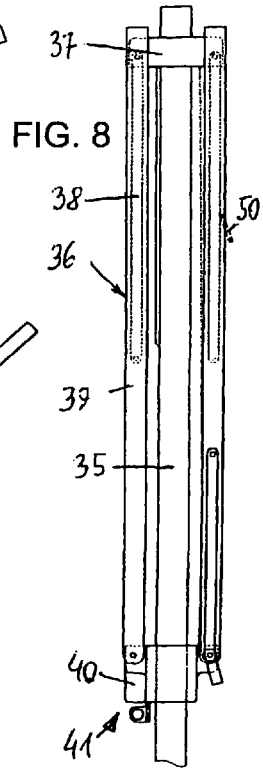
FIG. 8 is an enlarged, fragmentary, side-elevational view showing a further laundry dryer in the collapsed state.
Figure 9:
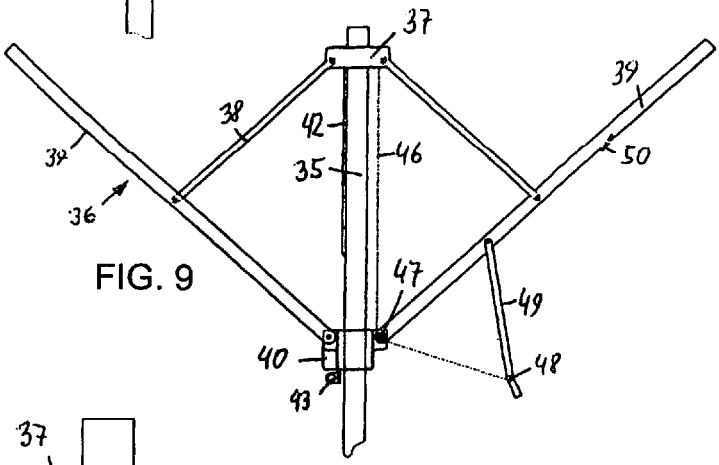
FIG. 9 is a fragmentary, side-elevational view of the laundry dryer of FIG. 8 in the partially unfolded state.
Figure 10:
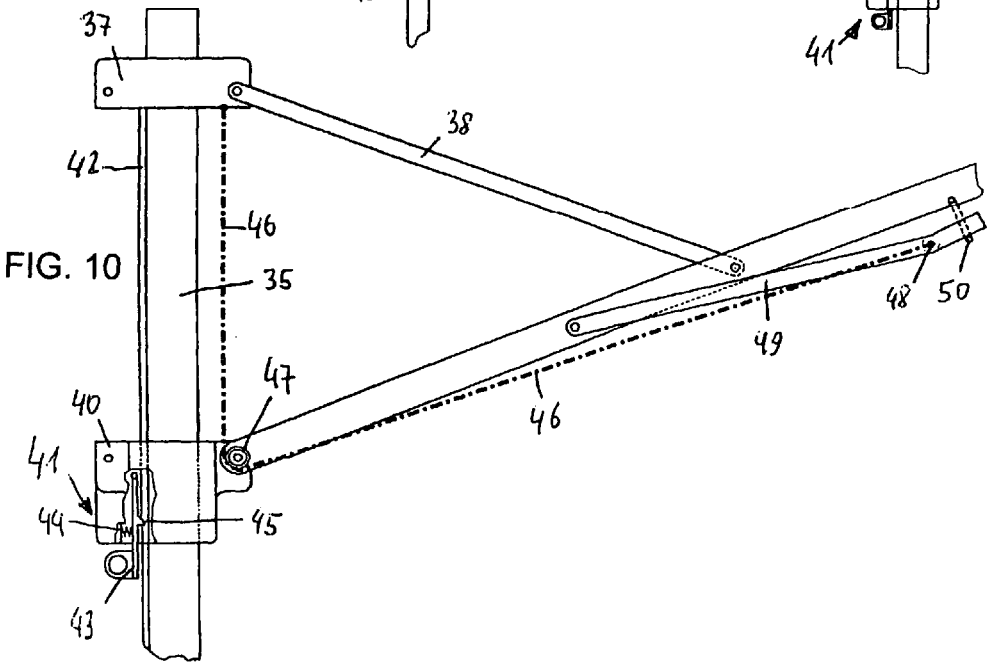
FIG. 10 is an enlarged, fragmentary, side-elevational view showing the laundry dryer of FIGS. 8 and 9 in the completely unfolded state.

FIGS. 8-10 show a further embodiment of an umbrella-like laundry dryer. In this embodiment, a central upright tube 35 carries a multi-armed carrying framework 36 for the clothes line. The carrying framework 36 has an upper sleeve 37 which is anchored to an upper end section of the upright tube 35 and to which are linked supporting arms 38 that are disposed in a star-shaped manner and are connected in an articulated manner at their lower ends to clothes-line carrying arms 39 disposed in a star-shaped manner. The clothes-line carrying arms 39 are linked at their lower ends to a lower sleeve 40 which can be displaced along the upright tube 35. The lower sleeve 40 carries a releasable fixing device 41 with which it can be fixed to the upright tube 35 in various height positions. A latching rail 42 is fitted along an upper half of the upright tube 35 and, when the carrying framework 36 is unfolded, interacts with the fixing device 41 of the lower sleeve 40.

The fixing device 41 has a pivotable ratchet lever 43 which extends in the longitudinal direction of the upright tube 35 and is acted upon in the locking direction by a spring 44. The ratchet lever 43 carries a ratchet 45 protruding from it toward the upright tube 35. When the carrying framework 36 is unfolded, the ratchet lever 43 latches through the use of its ratchet 45 in the latching rail 42 and fixes the lower sleeve 40 at the relevant height position on the upright tube 35.

The actuating device for unfolding the carrying framework 36 has a hoisting line 46 which is anchored to a lower side of the upper sleeve 37, runs downward parallel to the upright tube 35 and, at the lower sleeve 40, is deflected away from the upright tube 35 by a rotatable pulley 47 which is coaxial with the pivot axis of the clothes-line carrying arm 39. The hoisting line 46 is fastened at its lower end to a line engagement element 48 of an opening lever 49, which is linked to the clothes-line carrying arm 39 at an upper end of a lower third thereof. An upper half of the clothes-line carrying arm 39 carries a cable loop 50 thereon. The opening lever 49, which is pivoted into its upper position and is adjacent the upper half of the clothes-line carrying arm 39, can be fixed to the clothes-line carrying arm 39 with the cable loop 50. The cable loop 50 can be constructed in such a manner that it can be adjusted or contracted in order to be able to tighten the opening lever 49 to the clothes-line carrying arm 39.

FIGS. 11 to 14 show various embodiments of a locking device 51, with the aid of which an opening lever 52 of the actuating device can be fixed in its upper position to a carrying arm 53 of the clothes-line carrying framework, which carries the opening lever 52.

Figure 11:
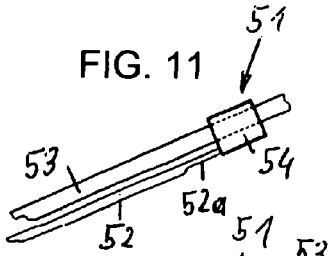
FIGS. 11-14 are enlarged, fragmentary, side-elevational views showing different embodiments of a locking device, fitted to a carrying arm, for an opening lever pivoted upward toward the carrying arm.

FIG. 11 shows a sleeve 54 which can be displaced in the longitudinal direction along the clothes-line carrying arm 53 and is pushed over an actuating end 52*a* of the opening lever 52 in order to fix the opening lever 52 when it is being pivoted into its upper position.

Figure 12:
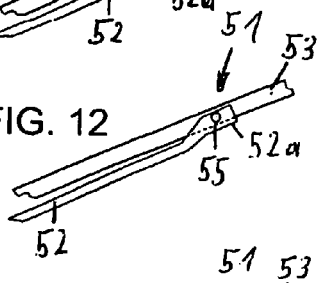

FIG. 12 shows an opening lever 52 which has been pivoted upward toward the clothes-line carrying arm 53 and the actuating end 52*a* of which engages laterally around the clothes-line carrying arm 53. The actuating end 52*a* is provided with recesses 55 which are latched to ball-type catches fitted to the clothes-line carrying arm 53.

Figure 13:
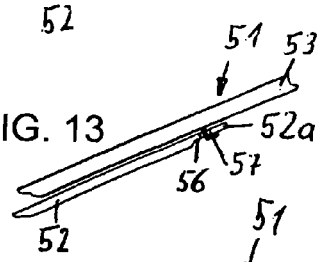

FIG. 13 shows a clothes-line carrying arm 53 and an opening lever 52, which is pivoted upward toward the latter, with a flattened actuating end 52*a* in which a passage opening 56 is provided. A toggle 57 protrudes from the lower side of the clothes-line carrying arm 53 and can be transferred from a straight position for passing through the passage opening 56, into a bent position in which it blocks the opening lever 52.

Figure 14:
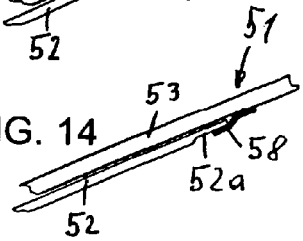

FIG. 14 shows a clothes-line carrying arm 53 and an opening lever 52, which has been pivoted upward toward the latter, with a flattened actuating end 52*a*. A clamp 58 is fitted to a lower side of the clothes-line carrying arm 53. The clamp can be rotated about an axis perpendicular to the clothes-line carrying arm 53 and can be rotated from a rest position into a blocking position (shown in FIG. 14) engaging over the actuating end 52*a* of the pivoted-upward opening lever 52.

Figure 15:
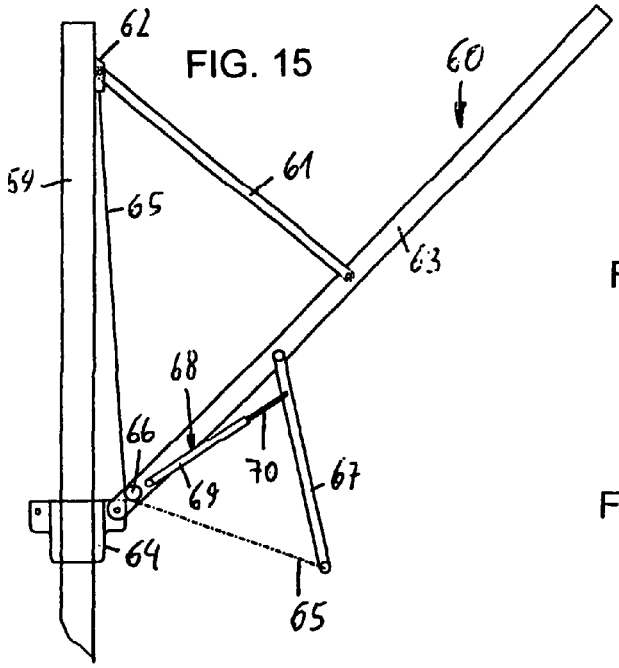
FIG. 15 is a fragmentary, side-elevational view of a further laundry dryer with the carrying framework partially unfolded.

FIG. 15 shows a further umbrella-like laundry dryer, in which a central upright tube 59 carries a multi-armed carrying framework 60 for the clothes line. Supporting arms 61, which are disposed in a star-shaped manner, are linked to ribs 62 protruding radially from the upright tube 59 and running vertically. Clothes-line carrying arms 63, which are connected in an articulated manner to the lower ends of the supporting arms 61, are linked at their lower ends to a lower sleeve 64 which can be displaced vertically along the upright tube 59 by a hoisting line 65. The hoisting line 65 is fastened at its upper end to a rib 62 protruding from the upright tube 59. The hoisting line 65 runs downward next to the upright tube 59 to the lower sleeve 64 and, above the latter, is deflected away outward from the upright tube 59 by a roller 66 mounted rotatably on a clothes-line carrying arm 63. A lower end of the hoisting line 65 is fastened to an actuating end of an opening lever 67. The opening lever 67 is mounted pivotably on the clothes-line carrying arm 63 above a lower third thereof. The opening lever 67 is coupled to the clothes-line carrying arm 63 through a gas-filled compression spring 68. The gas-filled compression spring 68 has a cylinder 69 connected in an articulated manner at its lower end to the clothes-line carrying arm 63 and a piston rod 70 connected in an articulated manner at its upper end to the opening lever 67.

When the carrying framework 60 is collapsed, the lower sleeve 64 is in its lowermost position. The supporting arms 61, which are linked to the upper end section of the upright tube 59, are pivoted downward toward the upright tube 59. The clothes-line carrying arms 63, which are coupled to the lower sleeve 64, are pivoted upward toward the upright tube 59. The opening lever 67, which is coupled to the hoisting line 65, is pivoted into its lower position and extends downward along the lower half of the clothes-line carrying arm 63.

Its downwardly pointing actuating end is connected to the lower end of the hoisting line 65 and is situated next to the lower sleeve 64, which is disposed in its lowermost position. The gas-filled compression spring 68 is pushed together into itself or contracted and extends along the lower half of the clothes-line carrying arm 63.

In order to unfold the carrying framework 60, the opening lever 67 is pulled away at its actuating end a short distance from the upright tube 59 and is pivoted upward. In the process, the hoisting line 65 is pulled past the roller 66, which is disposed on the lower end section of the clothes-line carrying arm 63, a short distance out of the collapsed carrying framework 60, and the lower sleeve 64, which is connected in an articulated manner to the clothes-line carrying arm 63, is raised a short distance. At the same time, the clothes-line carrying arms 63 are pivoted away at their upper ends from the upright tube 59 by a short distance and the supporting arms 61 are pivoted away at their lower ends from the upright tube 59 likewise by a short distance. Through the use of this first pivoting movement of the opening lever 67, the gas-filled compression spring 68 is pulled out somewhat and activated. The activated gas-filled compression spring 68 automatically expands in its longitudinal direction and pivots the opening lever 67 further until it reaches its upper position in which it then lies next to the upper half of the clothes-line carrying arm 63. In the process, the hoisting line 65, which is connected to the free end of the opening lever 67, is pulled out of the carrying framework 60 and the lower sleeve 64 is raised along the upright tube 59. As a result, the clothes-line carrying arms 63 coupled to the lower sleeve 64 are pivoted away in the radial direction from the upright tube 59 and at the same time are spread apart laterally. The clothes-line sections disposed between the clothes-line carrying arms 63 are pulled out in the horizontal direction and tensioned. The upward movement of the lower sleeve 64, which is generated by the gas-filled compression spring 68 through the pivoting of the opening lever 67, only comes to an end when the clothes-line carrying arms 63, which move apart laterally, are pulled out in the horizontal direction and the tensioned clothes line blocks the clothes-line carrying arms 63 from moving further laterally apart. The gas-filled compression spring 68 keeps the unfolded carrying framework 60 in its unfolded position, in which the clothes line is tensioned.

In order to collapse the carrying framework 60, the opening lever 67 is pivoted by hand from its upper position into its lower position. As a result, the gas-filled compression spring 68 is pushed together into itself and the arms of the carrying framework 60 are pivoted to the upright tube 59.

Figure 16:
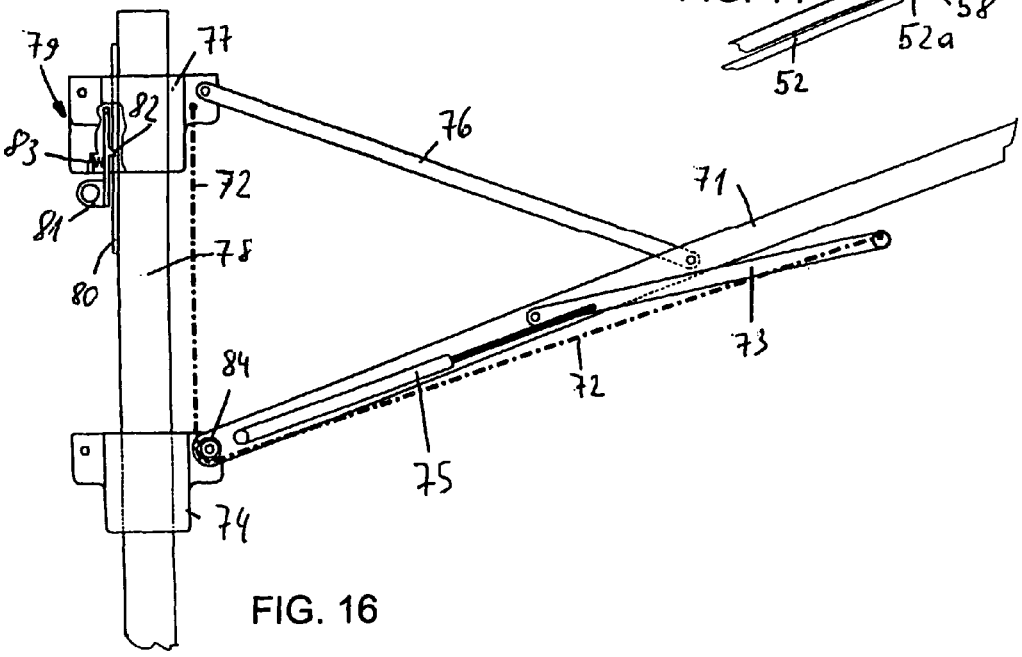
FIG. 16 is an enlarged, fragmentary, side-elevational view of a further laundry dryer with the carrying framework completely unfolded.

FIG. 16 shows a further umbrella-like laundry dryer, in which an opening lever 73, which is coupled to a hoisting line 72, is mounted pivotably on a carrying arm 71 of a clothes-line carrying framework above a lower sleeve 74 of the carrying framework. The opening lever 73 is coupled to the carrying arm 71 through a gas-filled compression spring 75 which assists the unfolding of the carrying framework. In the case of this clothes-line carrying framework, supporting arms 76, which are connected in an articulated manner to the carrying arms 71, are coupled at their upper ends to an upper sleeve 77. The upper sleeve 77 can be displaced vertically along an upper part of an upright tube 78. The upper sleeve 77 carries a fixing device 79 with which it can be fixed to the upright tube 78 in various height positions in a vertical latching rail 80. The fixing device 79 has a ratchet lever 81 which is mounted pivotably at its upper end in the upper sleeve 77 and has a ratchet 82 which engages in a notch of the latching rail 80. The ratchet 82 of the ratchet lever 81 is pressed in a notch of the latching rail 80 by a spring 83 and thereby blocks the vertical movement of the upper sleeve 77. A gripping eye is fitted to the lower end of the ratchet lever 81, with the aid of which the ratchet 82 can be pulled out of the latching rail 80 in order to then allow it to latch again in the latching rail 80 in a new height position of the upper sleeve 77 after a vertical displacement of the upper sleeve 77.

The hoisting line 72, which is coupled to the opening lever 73, is fastened at its upper end to the upper sleeve 77. The hoisting line 72 runs downward next to the upright tube 78 and, on the lower sleeve 74, is deflected away from the upright tube 78 by a rotatable pulley 84 which is coaxial with the pivot axis of the carrying arm 71. The hoisting line 72 runs away from the pulley 84 outward from the upright tube 78 and ends at a free end of the opening lever 73.

In the case of this laundry dryer, the working height of the clothes line, which is determined by the unfolded carrying framework, can be adjusted by adjustment of the height position of the upper sleeve 77. For this purpose, before the carrying framework is unfolded, the fixing device 79 of the upper sleeve 77 is released from the anchoring in the latching rail 80, and the upper sleeve 77 is displaced into a position corresponding to the desired working height of the clothes line. In this position, the upper sleeve 77 is again anchored to the upright tube 78, through its fixing device 79, which latches in the latching rail 80. The opening lever 73 is subsequently pulled at its actuating end away from the upright tube 78 by a short distance and is pivoted upward until the gas-filled compression spring 75 is activated which then automatically pivots the opening lever 73 upward and unfolds the carrying framework until the clothes line is tensioned.

Figure 17:
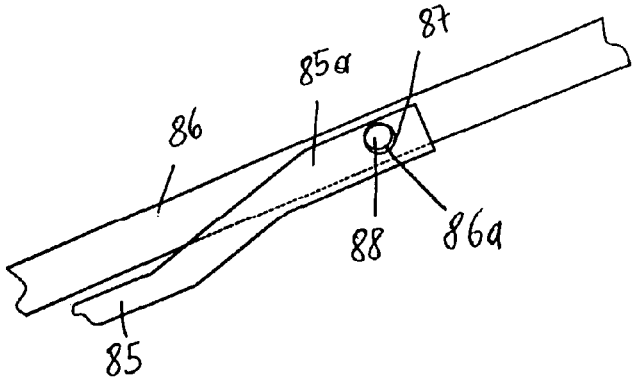
FIG. 17 is an enlarged, fragmentary, side-elevational view showing a further embodiment of a locking device, fitted to a carrying arm, for an opening lever pivoted upward toward the carrying arm.
Figure 19:
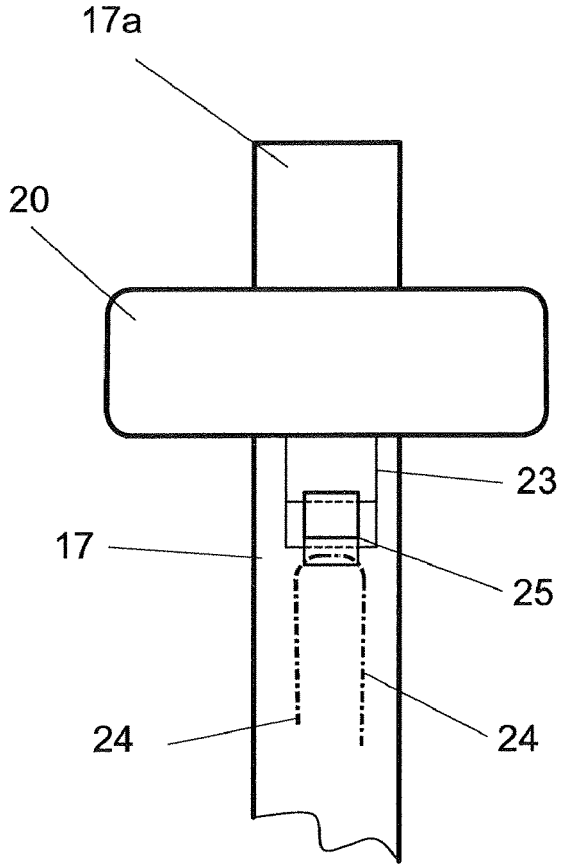
FIG. 19 is an enlarged, fragmentary, side-elevational view showing a top portion of FIG. 4.
Figure 20:
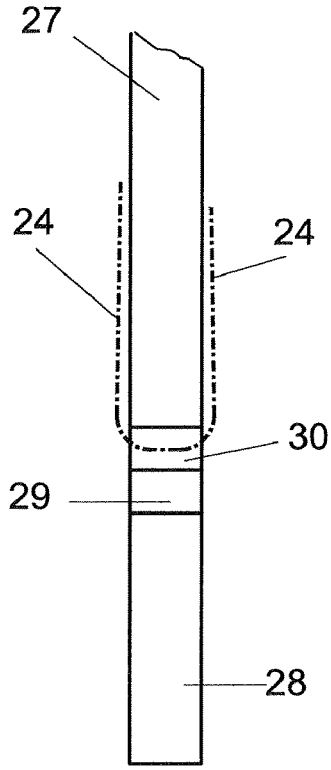
FIG. 20 is an enlarged, fragmentary, side-elevational view showing a bottom portion of FIG. 4.

FIG. 17 shows an opening lever 85 which has been pivoted upward toward the clothes-line carrying arm 86 and the actuating end 85*a* of which engages laterally around the clothes-line carrying arm 86. The actuating end 85*a* is provided with a hole 87 which overlaps a hole 86*a* in the clothes-line carrying arm 86 and a shear bolt 88 is inserted into the holes 86*a* and 87.

Figure 18:
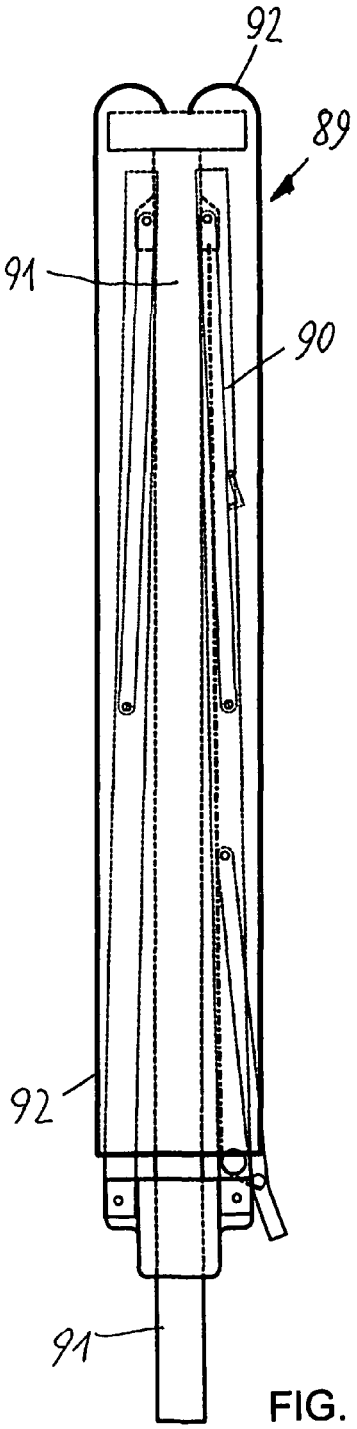
FIG. 18 is an enlarged, fragmentary, side-elevational view showing a further laundry dryer in the collapsed state with a tubular protective sheath partially pulled over the collapsed laundry dryer.

FIG. 18 shows a laundry dryer 89 in the collapsed state. The carrying framework 90 is collapsed toward the central upright tube 91. A tubular protective sheath 92 is disposed in the central upright tube 91, is pulled out of the central upright tube and is pulled from top to bottom over the collapsed carrying framework.

I claim:

1. An umbrella-like laundry dryer, comprising:

a central upright tube having an upper end section;

a multi-armed, clothes-line carrying framework to be unfolded and fixed in an unfolded state, said carrying framework including:

upper supporting arms disposed substantially in a star-shape around said upright tube, said upper supporting arms being pivotably linked at their upper ends with said upper end section of said upright tube and pivotably interconnected at their lower ends with intermediate portions of lower clothes-line carrying arms disposed substantially in a star-shape around said upright tube, said carrying arms being pivotably linked at lower ends thereof with a lower sleeve slidable along said upright tube, said carrying arms being spread out from said upright tube by sliding said lower sleeve along said upright tube;

an actuating device for unfolding said carrying framework by sliding said lower sleeve of said carrying framework along said upright tube, said actuating device including:

a hoisting line having a stationary upper end anchored to said upper end section of said upright tube, a hoisting line portion running downward adjacent to said upright tube and deflected away from said upright tube at or near said lower sleeve of said carrying framework, and a movable lower end, and an opening lever arranged on one of said lower clothes-line carrying arms, said opening lever being pivotable about a lever pivot axis arranged on said lower clothes-line carrying arm at a distance from a lower end of said clothes-line carrying arm, said opening lever having a hoisting line engagement element coupled with said movable lower end of said hoisting line, said hoisting line engagement element being disposed on said opening lever in an outer end section at or near the free actuating end of said opening lever, said opening lever being pivotable about said lever pivot axis by a pivoting movement from a downwardly pointing, lower position adjacent to the lower part of said clothes-line carrying arm into an upwardly pointing, upper position adjacent to the upper part of said clothes-line carrying arm, said movable lower end of said hoisting line being moved by said pivoting movement of said opening lever from a lower position adjacent to said lower sleeve of said carrying framework into an upper position adjacent to said upper part of said clothes-line carrying arm; and means for fixing the unfolded carrying framework in an unfolded state.

2. The laundry dryer according to claim 1, wherein said upper end section of said upright tube is provided with an upper sleeve surrounding said upright tube; said upper supporting arms of said carrying framework are pivotable linked at said upper ends with said upper sleeve; and said hoisting line of said actuating device being anchored by said stationary upper end to said upper sleeve.

3. The laundry dryer according to claim 2, wherein said stationary upper end of said hoisting line is anchored to said upper sleeve by an anchoring device

4. The laundry dryer according to claim 3, wherein said anchoring device includes at least two anchoring positions for said stationary upper end of said hoisting line and said anchoring positions are disposed vertically one above the other.

5. The laundry dryer according to claim 2, wherein said upper sleeve is vertically slidable along said upper end section of said upright tube and provided with a fixing device for anchoring said upper sleeve at different height positions to said upper end section of said upright tube.

6. The laundry dryer according to claim 1, wherein said upper end section of said upright tube is provided with radially protruding vertical ribs and said upper supporting arms of said carrying framework are pivotable linked at their upper ends with one of said vertical ribs and said hoisting line of said actuating device is anchored with its stationary upper end to one of said vertical ribs.

7. The laundry dryer according to claim 6, wherein said stationary upper end of said hoisting line is anchored to said vertical rib by an anchoring device.

8. The laundry dryer according to claim 7, wherein said anchoring device comprises at least two anchoring positions for said stationary upper end of said hoisting line and said anchoring positions are disposed vertically one above the other.

9. The laundry dryer according to claim 1, wherein said means for fixing the unfolded framework in an unfolded state is constituted by an opening lever locking device disposed on said upper part of said clothes-line-carrying arm for locking said opening lever when pivoted into said upwardly pointing, upper position.

10. The laundry dryer according to claim 9, wherein said opening lever locking device includes a first hole provided in said outer end section of said opening lever, a second hole provided in said upper part of said clothes-line carrying arm and a shear bolt to be inserted into said two holes when they overlap one another when said opening lever is in said upwardly pointing, upper position.

11. The laundry dryer according to claim 9, wherein said opening lever locking device includes ball-type catches fitted laterally to said upper part of said clothes-line-carrying arm and recesses provided in said outer end section of said opening lever which recesses are to be brought into engagement with said ball-type catches when said opening lever is in said upwardly pointing, upper position.

12. The laundry dryer according to claim 9, wherein said opening lever locking device includes an angle lever pivotally mounted on said upper part of said clothes-line carrying arm and to be brought into engagement with said outer end section of said opening lever when said opening lever is in said upwardly pointing, upper position.

13. The laundry dryer according to claim 9, wherein said opening lever locking device includes a cable loop coupled to said upper part of said clothes-line-carrying arm and to be brought into engagement with said outer end section of said opening lever and adjusted if appropriate.

14. The laundry dryer according to claim 9, wherein said opening lever locking device includes a sleeve to be displaced along said upper part of said clothes-line carrying arm and brought into engagement with said outer end section of said opening lever when said opening lever is in said upwardly pointing, upper position.

15. The laundry dryer according to claim 9, wherein said opening lever locking device includes a toggle protruding from a lower side of said upper part of said clothes-line carrying arm, said toggle passing through a passage opening within said outer end section of said opening lever when said opening lever is pivoted upward, and said toggle being transferable from a straight position into a bent position blocking said opening lever.

16. The laundry dryer according to claim 9, wherein said opening lever locking device includes a rotatable clamp fitted to a lower side of said upper part of said clothes-line carrying arm, said rotatable clamp to be rotated from a rest position into a blocking position engaging over said opening lever being pivoted upward into said upwardly pointing, upper position.

17. The laundry dryer according to claim 1, wherein said means for fixing the unfolded framework in an unfolded state is constituted by a lower sleeve fixing device disposed on said lower sleeve of said framework for fixing said lower sleeve on said upright tube when said lower sleeve is lifted by the hoisting line movement caused by said pivoting movement of said opening lever and said opening lever is pivoted into said upwardly pointing, upper position.

18. The laundry dryer according to claim 1, wherein said outer end section of said opening lever is provided with two hoisting line engagement elements disposed at different distances from said free actuating end of said opening lever.

19. The laundry dryer according to claim 1, wherein said actuating device includes a gas-filled compression spring linked to said lower clothes-line carrying arm and to said opening lever, said gas-filled compression spring to be activated by pivoting said opening lever upward, and said framework to be unfolded by said gas-filled compression spring automatically pivoting said opening lever upward towards said upwardly pointing, upper position.

20. The laundry dryer according to claim 19, wherein said gas-filled compression spring is linked to said lower clothes-line carrying arm near said lower end of said lower clothes-line carrying arm and linked to said opening lever at a third of said opening lever adjoining said pivot axis of said opening lever.

21. The laundry dryer according to claim 19, wherein said gas-filled compression spring is provided as said means for fixing the unfolded framework in an unfolded state, said framework to be unfolded by said gas-filled compression spring automatically pivoting said opening lever upward until reaching a position of said lower clothes-line carrying arms corresponding to a tensioned clothes line.

22. The laundry dryer according to claim 1, wherein said opening lever has on its free actuating end a handle protruding from the collapsed carrying framework when said opening lever is in said downwardly pointing, lower position.

23. The laundry dryer according to claim 1, wherein said hoisting line is a cable loop anchored to said upper end section of said upright tube and coupled to a said opening lever at said hoisting line engagement element.

24. The laundry dryer according to claim 23, wherein said cable loop has two cable sections running parallel to each other, running downward parallel to said upright tube and being deflected on said lower sleeve of said framework away from said upright tube by rotatable pulleys.

25. The laundry dryer according to claim 1, which further comprises a tubular protective sheath disposed in said central upright tube and to be pulled out of said central upright tube and to be pulled from top to bottom over said collapsed clothes-line carrying framework, over the clothes-line and over said opening lever pivoted into said downwardly pointing, lower position.

* * * * *